US005240649A

United States Patent [19]

Yamada et al.

[11] Patent Number: 5,240,649

[45] Date of Patent: Aug. 31, 1993

[54] ACCELERATING DEVICE FOR CARBURETOR

[75] Inventors: Minoru Yamada; Masao Akamine; Shoichi Mitsui; Tokihiko Aodai, all of Hamamatsu, Japan

[73] Assignee: Sanshin Kogyo Kabushiki Kaisha, Hamamatsu, Japan

[21] Appl. No.: 968,039

[22] Filed: Oct. 5, 1992

[30] Foreign Application Priority Data

Oct. 11, 1991 [JP] Japan ..... 3-91418[U]

[51] Int. Cl.[5] ..... F02M 7/093

[52] U.S. Cl. ..... 261/34.2

[58] Field of Search ..... 261/34.2

[56] References Cited

U.S. PATENT DOCUMENTS 2,551,719 5/1951 Ball ..... 261/34.2
2,649,290 8/1953 Griffon ..... 261/34.2
2,824,725 2/1958 Dietrich ..... 261/34.2
3,689,036 9/1972 Kikuchi et al. ..... 261/34.2

FOREIGN PATENT DOCUMENTS 45-20844 7/1970 Japan ..... 261/34.2

*Primary Examiner*—Tim Miles
*Attorney, Agent, or Firm*—Ernest A. Beutler

[57] ABSTRACT

An enrichment device for a charge forming system for an internal combustion engine that is responsive to induction system pressure for effecting a pumping action to draw fluid in when the engine is operating in a steady state condition and to discharge fluid for enrichment when the engine is being accelerated. The system includes a series of interrelated pressure sensing chambers for controlling the operation of the pump to avoid fluctuations during small variations in induction system pressure but to permit rapid and immediate pumping action upon sudden pressure changes.

8 Claims, 1 Drawing Sheet

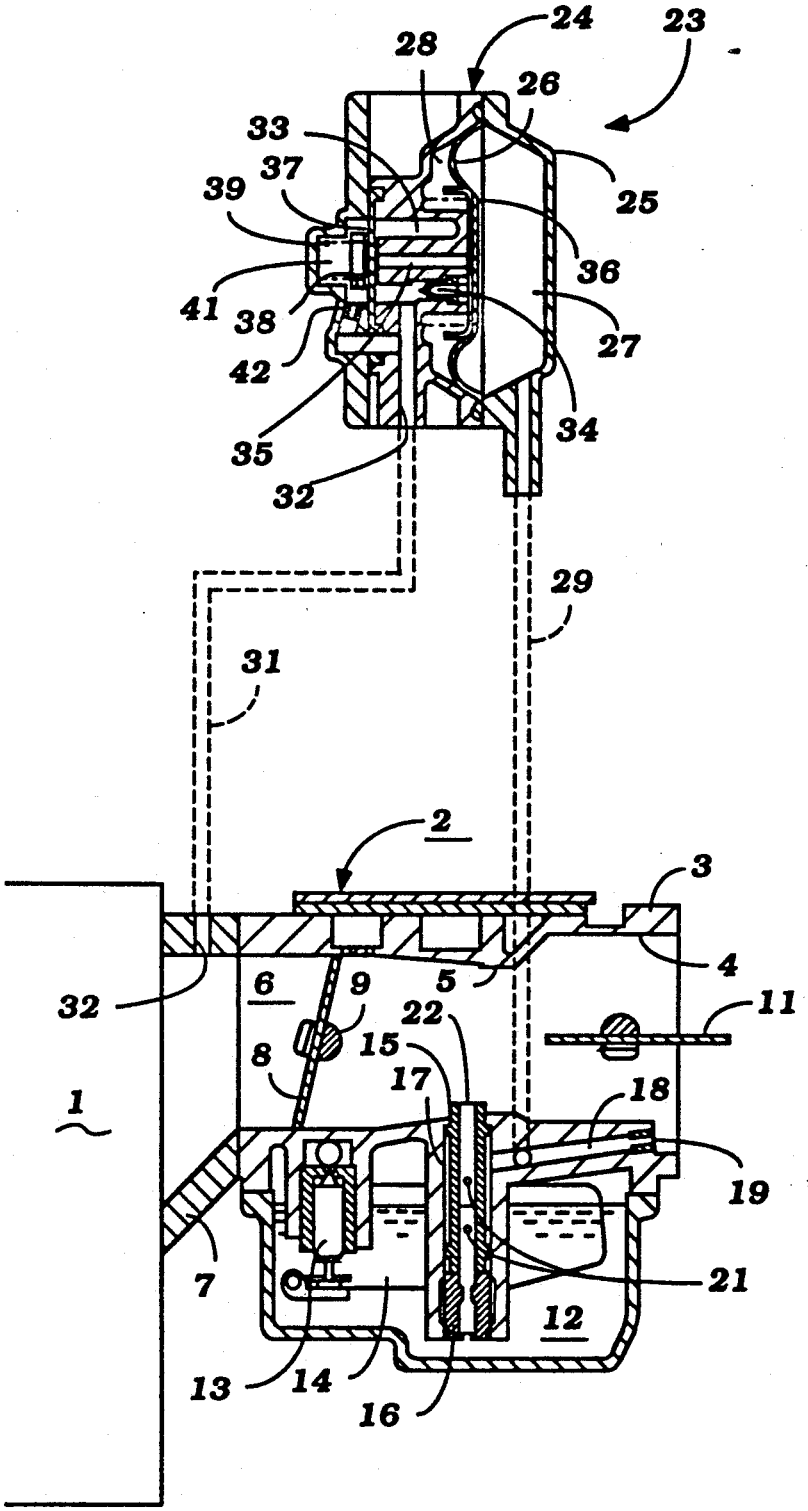
24
23
28
26
33
37
25
39
36
41
38
27
42
34
35
32
29
31
2
3
4
32
6
9
5
11
22
15
8
17
18
1
19
7
21
12
13
14
16

ACCELERATING DEVICE FOR CARBURETOR

BACKGROUND OF THE INVENTION

This invention relates to an accelerating device for an internal combustion engine and more particularly to an improved accelerating device for the charge forming system of an engine such as a carburetor.

As is well known with the internal combustion engines in which the fuel is introduced into the induction system of the engine rather than directly into the combustion chamber, the fuel/air ratio can deteriorate during sudden accelerations. As is well known, this leaning of the fuel/air mixture under accelerations is caused by the slower acceleration in the fuel flow than that of the air flow due to the greater density of the fuel. In order to provide smoother acceleration and the necessary enrichment, a wide variety of acceleration devices have been incorporated for adding fuel to the air flowing to the engine under extreme acceleration conditions.

One form of accelerating enrichment device employs a pumping chamber into which a fluid is drawn when the induction system vacuum is high, as it is under idle or steady state low speed operation. To accomplish this, a moveable wall separates a pumping chamber into which the fluid is drawn from a pressure sensing chamber that is in communication with the engine induction system. When the induction system pressure rises, indicating a rapid acceleration, the moveable wall is moved in a direction to force the fluid which has been drawn into the pumping chamber into the induction system for enrichment purposes.

A disadvantage of this type of accelerating enrichment device is that the pressure sensing chamber will be subjected to varying pressures and this can cause the moveable wall to move and reduce the volume of fluid pumped. These pressure variations are caused due to a wide variety of reasons, such as the fact that the induction system pressure may vary due to the fact that one or more engine chambers are supplied by the induction system and the pulsations in pressure flow can cause such variations.

To avoid these problems, it has been proposed to provide a second pressure sensing chamber that communicates with the first pressure sensing chamber through a check valve so as to isolate the first pressure sensing chamber from fluctuations in pressure in the second pressure sensing chamber. However, because of the provision of the check valve, it is necessary to provide a further passage communicating the second pressure sensing chamber with the first pressure sensing chamber so as to effect movement of the wall when the induction system pressure rises significantly to indicate the necessity for the introduction of acceleration fuel. However, this communicating passageway must be made relatively small so as to avoid movement of the wall under the aforenoted pressure variations. This causes the pumping operation to be somewhat diminished since the increased pressure in the induction system is not rapidly transmitted to the first pressure sensing chamber and hence the performance of the accelerating device may be deteriorated.

It is, therefore, an object of this invention to provide an improved accelerating device for an internal combustion engine in which the accelerating fuel supply is dampened from pressure variations in the induction system but also wherein the amount of accelerating fuel can be rapidly transmitted when called for.

It is a further object of this invention to provide an improved accelerating fuel device for an internal combustion engine induction system wherein pressure variations in the induction system will not adversely affect the output of the device but wherein the device can also rapidly supply accelerating fuel when called for.

SUMMARY OF THE INVENTION

This invention is adapted to be embodied in an enrichment device for an engine charge forming system operative upon sudden accelerations. The device comprises a pumping chamber and a first pressure sensing chamber which are separated by a moveable wall for drawing a fluid into the pumping chamber upon movement of the wall in a first direction and for discharge of fluid from the pumping chamber upon movement of the wall in a second direction opposite to the first direction. A second pressure sensing chamber communicates through conduit means with the engine induction system. A check valved passage permits flow from the first pressure sensing pressure chamber to the second pressure sensing chamber upon reduced pressure in the engine induction system for effecting movement of the wall in the first direction and for precluding flow from the second pressure sensing chamber to the first pressure sensing chamber. A substantially unrestricted passage communicates the second pressure sensing chamber with the first pressured sensing chamber and valve means control the flow through this unrestricted passage. Means are provided for opening the valve means in the event of a sudden change in induction system pressure for effecting rapid movement of the wall to pump fluid from the pumping chamber to the engine.

BRIEF DESCRIPTION OF THE DRAWINGS

The single figure of drawings is a partially schematic view of an engine with the charge forming system shown in cross section and embodying an enrichment device constructed in accordance with an embodiment of the invention.

DETAILED DESCRIPTION OF THE PREFERRED EMBODIMENT OF THE INVENTION

In the drawings, an internal combustion engine having an induction and fuel charging system constructed in accordance with an embodiment of the invention is shown partially and in a schematic fashion and indicated generally by the reference numeral 1. In the illustrated embodiment, the engine 1 is a multi-cylinder two cycle crankcase compression internal combustion engine. It will be readily apparent to those skilled in the art, however, that the invention may be employed in conjunction with various types of engines. The charge forming and induction system which is disclosed is related with a single cylinder of the engine 11 and it will be readily apparent to those skilled in the art how the invention may be employed with multiple cylinder engines.

The charge forming system for the engine 1 includes a carburetor 2 having a main body portion 3 which defines an air horn 4 to which atmospheric air is delivered from an air intake device (not shown). Downstream from the air horn 4, the carburetor 2 is provided with a venturi section 5 which communicates with an induction passage 6 which discharges, in turn, to an intake manifold 7 for delivering the charge to the crankcase chambers of the engine 1. As is typical with two cycle engine practice, a reed type check valve (not shown) will be interposed between the intake manifold 7 and the individual crankcase chambers.

A manually positioned throttle valve 8 is provided on a throttle valve shaft 9 in the intake passage 6 downstream of the venturi section 5 for controlling the speed of the engine. In addition, a choke valve 11 is positioned in the air horn 4 upstream of the venturi section 5 for providing an enriched mixture for cold starting and cold running. The choke valve 11 may be operated either manually or automatically in any well known manner.

The carburetor 2 is provided with a float bowl 12 to which fuel is admitted from a fuel delivery system through a needle valve 13 operated by a float 14 for maintaining a uniform head of fuel in the fuel bowl 12 as is well known in this art. A main fuel discharge nozzle 15 depends into the fuel bowl 12 and has a main metering jet 16 disposed at its lower end. A mixing chamber 17 surrounds the main nozzle 15 and air is admitted to the chamber 17 from an atmospheric air bleed 18 with the amount of air inducted controlled by an air metering jet 19. A plurality of apertures 21 are formed around the main nozzle 15 and communicate with its discharge 22 which, in turn, extends into the throat of the venturi section 15.

As the engine runs, fuel will be drawn through the main metering jet 16 and mixed with air passing through the openings 21 to form a fuel/air emulsion that is discharged from the passage 22 into the venturi section 5 in a well known manner.

In addition to the main fuel system, thus far described, the carburetor 2 may also include idle and/or transition circuits, as are well known in this art. Since the invention relates to the accelerated enrichment, now to be described, rather than the carburetor 2 per se, further description of the carburetor is not believed to be necessary to permit those skilled in the art to practice the invention.

An enrichment device, indicated generally by the reference numeral 23 is provided for cooperation with the carburetor 2 so as to provide additional fuel to the engine 1 during acceleration conditions. As is well known, when the engine is accelerated rapidly, the carburetor 2 will provide a leaner than desired air/fuel ratio because of the fact that the heavier more dense liquid fuel from the fuel bowl 12 will accelerate slower than the air flowing through the induction passage 6 and venturi section 5. Thus, unless some enrichment is provided for this transient condition, uneven running may occur due to the resulting lean mixture.

The enrichment device 23, is depicted as being mounted separately from the carburetor 2 but in actual practice it may be mounted directly on the body 3 of the carburetor 2 or may be formed integrally with it. Alternatively, the enrichment device 23 may be a separate unit mounted separately as shown in the drawing.

The enrichment device 23 includes a body assembly, indicated generally by the reference numeral 24 which includes a cover plate 25 that holds a moveable wall in the form of a flexible diaphragm 26 between a pumping chamber 27 formed by the cover plate 25 and a first pressure sensing chamber 28 formed by the diaphragm 26 and body assembly 24. The pumping chamber 27 communicates with the air passage 17 of the carburetor 2 by means of a conduit shown in broken lines and identified by the reference numeral 29. When the diaphragm 26 is moved to the position shown in the figure, air will be drawn from the air portion of the main fuel discharge circuit and fill the pumping chamber 27. When the diaphragm 26 is moved to its opposite position, in a manner to be described, this air will be forced back through the conduit 29 to add pressurized air to the air portion of the main fuel discharge circuit and force this air through the passages 21 to draw fuel from the fuel bowl 12 and provide fuel enrichment under acceleration conditions. Although the system is described in conjunction with an arrangement wherein air from the main fuel discharge circuit is pumped to create additional fuel flow, fuel per se may be pumped by the enrichment device 23.

The pumping action is achieved by varying the pressure in the pressure sensing chamber 28 in response to the pressure in the induction system downstream of the throttle valve 8. For this purpose, a pressure sensing conduit, indicated in phantom by the reference numeral 31 extends from a vacuum sensing port 32 in the manifold 7 to a passage 32 formed in the body assembly 24 of the enrichment device which passage 32 communicates with a second pressure sensing chamber 33. The second pressure sensing chamber 33 communicates with the pressure sensing chamber 28 through a duct bill type of check valve 34 which will permit air flow from the pressure sensing chamber 28 to the pressure sensing chamber 33 but not flow in the opposite direction. The check valve 34 serves a function of preventing fluctuations in induction system vacuum for effecting pulsations of the diaphragm 26 which could adversely effect its operation and reduce its pumping capacity.

A substantially unrestricted flow passage 35 extends through the housing assembly 24 from the second pressure sensing chamber 33 to the first pressure sensing chamber 28. In the event intake manifold vacuum falls (absolute pressure rises) this pressure will pass through the unrestricted passageway 35 of the chamber 33 to the pressure sensing chamber 28 to act on the diaphragm 26 along with a coil compression spring 36 to cause the diaphragm 26 to move to the right, compress the pumping chamber 27 and cause fluid flow through the conduit 29 to provide the aforenoted fuel enrichment.

However, if the passage 35 is continuously left in an open condition, then the damping action of the check valve 34 will be defeated. Therefore, in accordance with the invention, a further valve is provided which cooperates with the passage 35 to maintain it in a normally closed position, except in the event of an extreme acceleration and rapid drop of intake manifold vacuum or increase in actual pressure in the induction system. This valve is formed by a further diaphragm 37 which has a rib portion 38 that acts as a seal around the passage 35. A coil compression spring 39 is positioned in a third pressure sensing chamber 41 and acts with the diaphragm 37 to close the passageway 35 as shown in the figure. The third pressure sensing chamber 41 communicates with the second pressure sensing chamber 33 and pressure sensing conduit 31 through a restricted passageway 42. As a result of the restricted passageway 42, the change in pressure in the third pressure sensing chamber 41 will occur at a slower rate than the change in pressure in the second pressure sensing chamber 33. It is this pressure difference between the chambers 33 and 41 which effects the opening and closing of the valve controlling the flow through the passageway 35, as will now be described.

Assuming the engine is started and is operating at idle, a low manifold pressure or high manifold vacuum will exist at the port 32 and air will be drawn from the pressure sensing chambers 41, 33 and 28 with the air flow occurring primarily through the check valve 34 so as to evacuate the chamber 28 and effect movement of the diaphragm 26 to the left so as to increase the volume of the pumping chamber 27 and draw air or other fluid into the chamber 27 in the manner previously described. Under a steady state condition, the pressure in the chambers 33 and 41 will be substantially the same and the passageway 35 will be closed by the action of the spring 39 on the diaphragm 37.

As the engine continues to run, there will be periodic pulsations in the intake system pressure as occurs during normal operation and these pulsations will be transmitted through the port 32 and conduit 31 to the second pressure sensing chamber 33. However, the check valve 34 will avoid any pulsation of the diaphragm 37 and since the passageway 35 will be closed, there will be no adverse effects.

However, as the throttle valve 8 is opened suddenly, the pressure in the induction system will arise abruptly and this increase in pressure will be passed through the conduit 31 and passageway 32 of the enrichment device 23 to the pressure sensing chamber 33. Because of the restriction 42, the pressure in the pressure sensing chamber 33 will rise faster than the pressure in the pressure sensing chamber 41 and the diaphragm 37 will be urged to the left against the action of the spring 39 and open the unrestricted passageway 35. The increase air pressure then passes to the first pressure sensing chamber 28 and forces the diaphragm 27 to the right to compress the pumping chamber 27 and force the fluid through the conduit 29 into the main fuel system of the carburetor 2 to cause the aforenoted enrichment. Hence, smooth transitional acceleration will occur.

After the pumping chamber 27 has been emptied by the operation of the diaphragm 26 and assuming that the engine maintains a steady state condition, the pressure in the chambers 33 and 41 will stabilize and become equal and the passageway 35 will then be closed. As induction system vacuum is generated, the check valve 34 will open and the pressure in the chamber 28 will again be drawn down so as to move the diaphragm 26 to the left and again fill the pumping chamber 27 so as to be ready for the next acceleration condition.

It should be readily apparent from the foregoing description that the system is very effective in providing automatic enrichment upon acceleration without having pulsations occur in the enrichment device and while, at the same time, assuring quick response due to the unrestricted passageway 35. Of course, the foregoing description is that of an improved embodiment of the invention and various changes and modifications may be made without departing from the spirit and scope of the invention, as defined by the appended claims.

We claim:

1. An enrichment device for an engine charge forming system operating upon sudden accelerations, said device comprising a pumping chamber and a first pressure sensing chamber separated by a moveable wall for drawing fluid into said pumping chamber upon movement of said wall in a first direction and for discharge of fluid from said pumping chamber upon movement of said wall in a second direction, opposite to said first direction, a second pressure sensing chamber, conduit means connecting the engine induction system with said second pressure sensing chamber, a check valved passage for permitting flow from said first pressure sensing chamber to said second pressure sensing chamber upon reduced pressure in said induction system for effecting movement of said wall in said first direction and for precluding flow from said second pressure sensing chamber to said first pressure sensing chamber, a substantially unrestricted passageway communicating said second pressure sensing chamber with said first pressure sensing chamber, valve means for controlling the flow through said unrestricted passage, and means for opening said valve means upon a sudden increase in induction system pressure for communicating induction system pressure with said first pressure sensing chamber for urging said wall in said second direction for expelling fluid from said pumping chamber to provide acceleration enrichment.

2. An enrichment device as set forth in claim 1 wherein the moveable wall comprises a diaphragm separating the pumping chamber from the first pressure sensing chamber.

3. An enrichment device as set forth in claim 2 wherein the charge forming system includes a carburetor having a main fuel discharge circuit and the pumping chamber communicates with said main fuel discharge circuit of the carburetor for effecting enrichment fuel flow upon pumping action.

4. An enrichment device as set forth in claim 1 wherein the valve means is a pressure responsive valve means responsive to a pressure difference between the second pressure sensing chamber and a third pressure sensing chamber communicating with the second pressure sensing chamber through a restricted passageway.

5. An enrichment device as set forth in claim 4 wherein the valve means comprises a moveable diaphragm separating the second pressure sensing chamber from the third pressure sensing chamber and cooperating with an end of the passage for controlling the flow through the passage.

6. An enrichment device as set forth in claim 5 further including biasing spring means for urging said diaphragm to its closed position.

7. An enrichment device as set forth in claim 6 wherein the moveable wall comprises a second diaphragm separating the pumping chamber from the first pressure sensing chamber.

8. An enrichment device as set forth in claim 7 wherein the charge forming system includes a carburetor having a main fuel discharge circuit and the pumping chamber communicates with said main fuel discharge circuit of the carburetor for effecting enrichment fuel flow upon pumping action.

* * * * *